US006698532B2

(12) United States Patent
Gotou et al.

(10) Patent No.: US 6,698,532 B2
(45) Date of Patent: Mar. 2, 2004

(54) PIERCING APPARATUS

(75) Inventors: Manabu Gotou, Kitakyushu (JP); Keisuke Morimitsu, Kitakyushu (JP); Hiromi Kawakami, Hiroshima (JP); Tuneo Iwasaki, Hiroshima (JP); Kazuo Haga, Hiroshima (JP); Yoshiichi Yatagai, Hiroshima (JP); Manpei Hontani, Fukuoka (JP); Hiroyuki Takao, Kitakyushu (JP)

(73) Assignees: Nippon Steel Corporation, Tokyo (JP); Yamamoto Rock Machine Co., Ltd., Tokyo (JP); Nittetsu Plant Designing Corporation, Fukuoka (JP)

( * ) Notice: Subject to any disclaimer, the term of this patent is extended or adjusted under 35 U.S.C. 154(b) by 0 days.

(21) Appl. No.: 10/379,772

(22) Filed: Mar. 5, 2003

(65) Prior Publication Data

US 2003/0136569 A1 Jul. 24, 2003

Related U.S. Application Data

(62) Division of application No. 09/567,640, filed on May 9, 2000, now Pat. No. 6,601,655.

(30) Foreign Application Priority Data

May 10, 1999 (JP) ..... 11-128241

(51) Int. Cl.[7] ..... B25D 9/18

(52) U.S. Cl. ..... 173/206; 173/4; 173/104; 173/128; 173/210; 173/222

(58) Field of Search ..... 173/104, 206, 173/207, 105, 4, 11, 13, 91, 114, 109, 210, 212, 48

(56) References Cited

U.S. PATENT DOCUMENTS

| | | | | |
|---|---|---|---|---|
| 3,955,478 A | | 5/1976 | Feucht | 173/206 |
| 5,040,618 A | | 8/1991 | Morrison et al. | 173/104 |
| 5,060,734 A | | 10/1991 | Anderson et al. | 173/206 |
| 5,129,466 A | | 7/1992 | Bartels et al. | 173/13 |
| 5,259,464 A | | 11/1993 | Bartels et al. | 173/91 |
| 5,348,430 A | | 9/1994 | Metz et al. | 408/239 R |
| 5,415,240 A | | 5/1995 | Mundjar | 173/105 |
| 5,437,338 A | * | 8/1995 | Martin et al. | 173/206 |
| 5,520,254 A | | 5/1996 | Weber | 173/207 |
| 6,601,655 B1 | * | 8/2003 | Gotou et al. | 173/206 |

FOREIGN PATENT DOCUMENTS

| | | |
|---|---|---|
| DE | 4404009 | 4/1995 |
| EP | 0930476 | 7/1999 |
| JP | 6-322420 | 11/1994 |
| JP | 10-36905 | 2/1998 |

* cited by examiner

*Primary Examiner*—Scott A. Smith
(74) *Attorney, Agent, or Firm*—Kenyon & Kenyon

(57) ABSTRACT

A piercing apparatus compact in size having a decreased number of hoses is suited for use as an iron runner port-opening machine for a blast furnace or the like furnace in an iron mill. The piercing apparatus executes the piercing by moving back and forth, by using a feed unit, a drifter equipped with a forward-blowing unit, a reverse-blowing unit and a rotary unit, and wherein cylinders containing a cylindrical blowing piston are provided in front of, and at the back of, a drifter body maintaining a distance relative to each other; a shank rod having, formed as a unitary structure, a blowing portion of a large diameter with blowing surfaces formed on the front and rear portions thereof and rod-like small-diameter portions protruding forward and backward beyond the blowing portion, is provided along the axial direction of the drifter body in a manner that the blowing portion is positioned between the front cylinder and rear cylinder and that the small-diameter portions on both sides are fitted to the cylindrical blowing pistons of the respective sides; and valves are provided in the outer peripheral portions of the front and rear cylinders to supply hydraulic pressure into the cylinders.

3 Claims, 12 Drawing Sheets

PIERCING APPARATUS

This application is a divisional application under 35 U.S.C. §120 and §121 of prior application Ser. No. 09/567,640 filed May 9, 2000, now U.S. Pat. No. 6,601,655. The entire disclosure of prior application Ser. No. 09/567,640 filed May 9, 2000 is considered part of the divisional application and is hereby incorporated by reference.

BACKGROUND OF THE INVENTION

1. Field of the Invention

The present invention relates to a piercing apparatus suited for use as an iron runner port-opening machine for a blast furnace, or the like furnace, in an iron and steel factory.

2. Description of the Related Art

As an iron runner port-opening machine for a blast furnace, or the like furnace, in general, there has been widely used a hydraulic drifter having a cylinder for slidably holding a piston that moves back and forth, and a sleeve for holding a shank rod attached to a front portion of the cylinder, so that the piston is advanced by the hydraulic pressure supplied to the cylinder to blow the shank rod. A piercing rod is joined to an end of the shank rod, and a bit is attached to an end of the piercing rod to execute the piercing. During the piercing operation, a thrust is imparted to the drifter by a feed unit provided on a support unit that supports the drifter when the piercing is effected to a desired depth, the drifter is moved back to withdraw the piercing rod and the bit from the hole that is pierced. In this case, however, there frequently occurs an accident, i.e., a so-called jamming in which the bit is not easily withdrawn as the pierced hole is stuffed with the pulverized scraps on the back side of the bit.

In order to easily withdraw the bit and the rod despite such an accident has occurred, there has been already developed a hydraulic piercing apparatus equipped with a reverse-blowing unit to give a backward blow to the rod (Japanese Patent No. 2613538). The piercing apparatus equipped with the reverse-blowing unit has been widely used for opening the iron runner port of a blast furnace, since it makes it possible to relatively easily withdraw the rod by actuating the reverse-blowing unit when the rod cannot be withdrawn. On the site of work of this kind, however, much limitation is imposed on the working space, and it has been urged to provide a more compact piercing apparatus. Besides, the above conventional piercing apparatus requires at least five thick hydraulic hoses for operating the piercing apparatus, i.e., a hydraulic hose for forward blowing, a hydraulic hose for reverse blowing, a hydraulic hose for forward rotation, a hydraulic hose for reverse rotation, and a return hydraulic hose for forward and reverse blows, resulting in a complex external structure and hindering the operability.

SUMMARY OF THE INVENTION

It is therefore a requirement of the present invention to provide a piercing apparatus which is compact in size and uses a decreased number of hoses as a result of improving the above-mentioned conventional forward/reverse blow-type piercing apparatus.

In order to solve the above assignment, the present invention employs the following constitution. That is, the piercing apparatus of the invention executes the piercing by moving, back and forth by using a feed unit, a drifter equipped with a forward-blowing unit, a reverse-blowing unit and a rotary unit; wherein cylinders containing a cylindrical blowing piston are provided in front of, and at the back of, a drifter body maintaining a distance relative to each other;

a shank rod having, formed as a unitary structure, a blowing portion of a large diameter with blowing surfaces formed on the front and rear portions thereof and rod-like small-diameter portions protruding forward and backward beyond the blowing portion, is provided along the axial direction of the drifter body in a manner that the blowing portion is positioned between the front cylinder and rear cylinder and that the small-diameter portions on both sides are fitted to the cylindrical blowing pistons of the respective sides; and valves are provided in the outer peripheral portions of the front and rear cylinders to supply hydraulic pressure into the cylinders.

The rotary unit can be constituted in a relatively compact size if a spline is formed in the outer peripheral portion of the blowing portion of the shank rod, and if a chuck that transmits the rotation, by being spline-fitted to the blowing portion, is rotated by the rotary unit provided on the outer peripheral portion of the drifter body.

Further, a pilot valve unit is provided on the outer peripheral portion of the drifter body to selectively change the hydraulic pressure for blowing over to the valve for forward blowing or over to the valve for reverse blowing, and is changed over by the hydraulic pressure supplied to the feed unit in a manner that the hydraulic pressure is supplied to the valve for forward blowing by the hydraulic pressure for moving the feed unit forward and that the hydraulic pressure is supplied to the valve for reverse blowing by the hydraulic pressure for moving the feed unit backward. Then, the forward blow and the reverse blow are automatically changed over depending upon the change-over of the feed.

It is desired that a pilot valve unit for selectively changing the hydraulic pressure for rotation, over to the valve for forward rotation or over to the valve for reverse rotation, is provided on the outer peripheral portion of the drifter body from the standpoint of shortening the conduits and decreasing the size.

In the above piercing apparatus, it is desired to install, in a heat-resistant box, a valve for changing over all or part of the hydraulic pressure supplied to the blowing unit, rotary unit and feed unit and a valve for controlling the flow rate and pressure, and to install a cooling unit for forcibly cooling the interior of the heat-resistant box by purging the air as means for cooling the heat-resistant box. With the valve unit being installed near a guide cell for moving the drifter, the valve system can be constituted in a compact size. Similarly, it is desired to install, in a similar heat-resistant box, a valve for changing over all or part of the hydraulic pressure supplied to the blowing unit, rotary unit, feeding unit and to the pilot valve that changes over the direction of the blowing unit and the rotary unit, as well as to install a control valve for controlling the flow rate and pressure.

It is further desired from the standpoint of compactly arranging the hydraulic conduits that a return hydraulic pressure from the forward-blowing unit and the reverse-blowing unit meet a return hydraulic pressure from the rotary unit and/or the feed unit through the valve unit, so that the return hydraulic pressure is returned to a fluid tank through a common hydraulic hose.

DESCRIPTION OF THE PREFERRED EMBODIMENT

Figure 1:
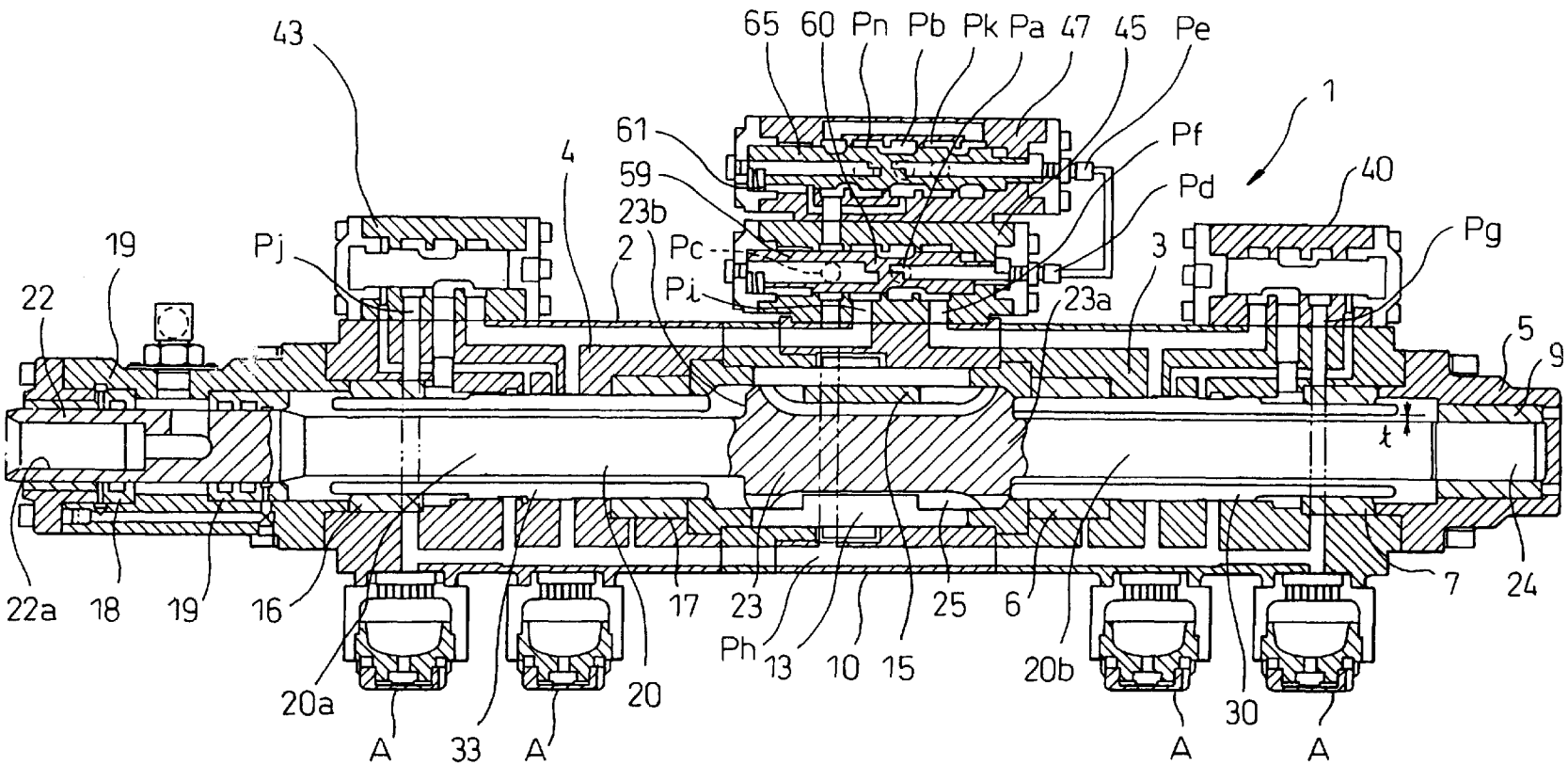
FIG. 1 is a vertical sectional view of a drifter according to an embodiment of the invention and illustrates a portion thereof in an expansion plan.
Figure 2:
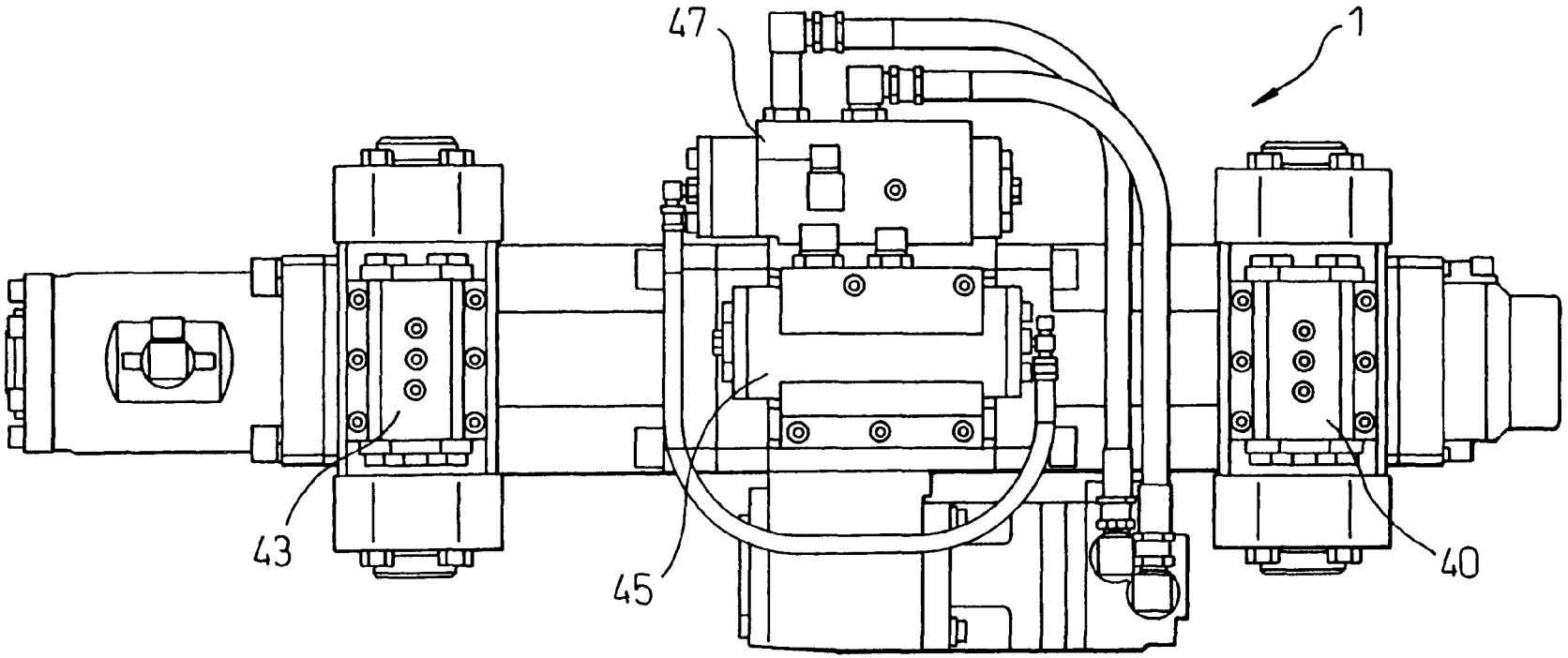
FIG. 2 is a plan view of FIG. 1.
Figure 3:
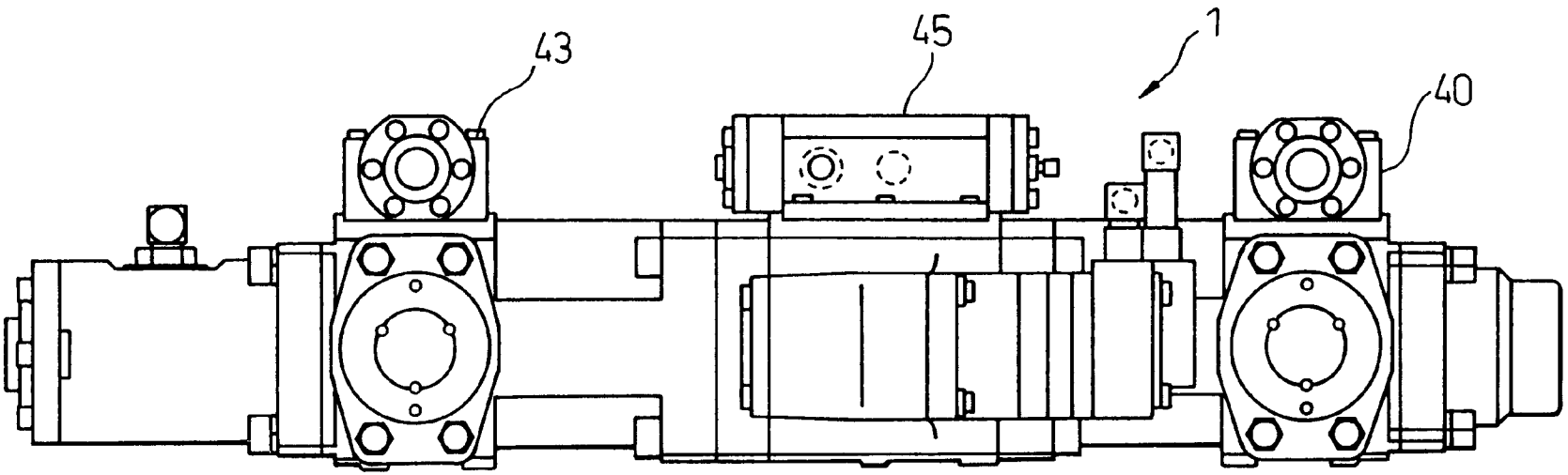
FIG. 3 is a side view of FIG. 1.
Figure 4:
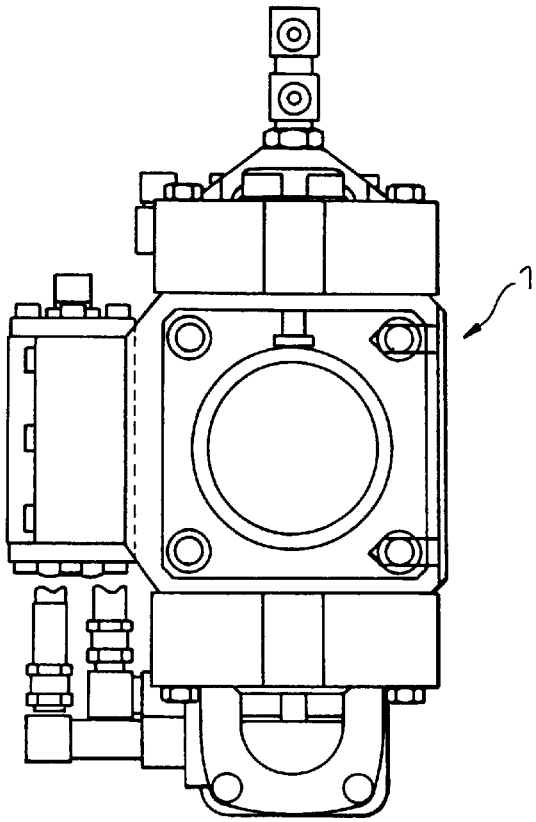
FIG. 4 is a back view of FIG. 1.
Figure 5:
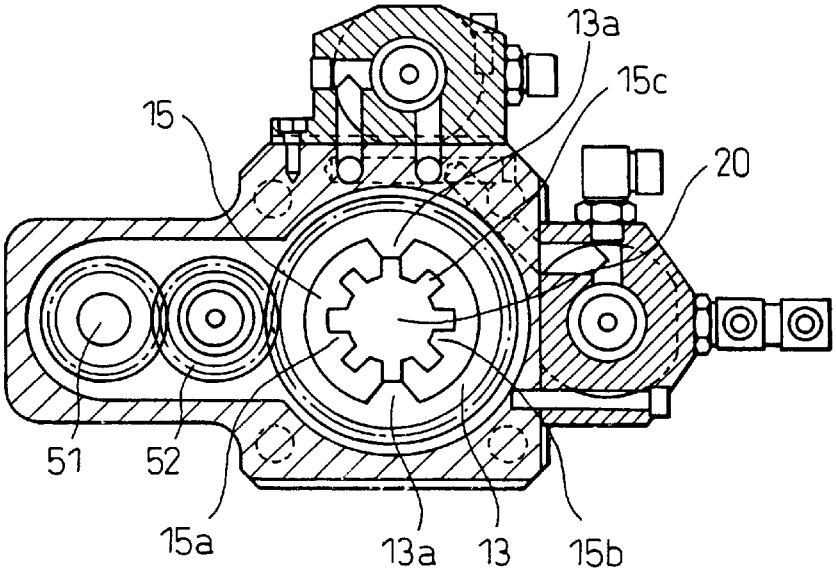
FIG. 5 is a sectional view along X—X of FIG. 2.

Hereinafter, an embodiment of the invention will be concretely described. The drawings illustrate an embodiment of the invention wherein, as shown in FIG. 1, a main body 2 of a drifter 1 of the piercing apparatus is provided with a cylinder 3 for forward blowing and a cylinder 4 for reverse blowing arranged in series at a predetermined distance. Bushings 6 and 7 are provided at both front and rear ends of the cylinder 3 for forward blowing, and a hollow rear cap 5 in the shape of a bag is secured by bolts to the rear portion of the cylinder 3. A bushing 9 is provided in the inner surface of the rear cap 5.

An intermediate cylinder 10 is connected between the cylinder 3 for forward blowing and the reverse-blowing unit. A chuck driver 13 having a tooth train 13*a* formed on the outer peripheral surface thereof is rotatably supported by bush in the inner periphery of the intermediate cylinder 10, and a chuck 15 is fitted into the chuck driver. The chuck 15 is divided into two chuck pieces 15*a*, 15*a* of nearly a fan shape, and a female spline 15*c* is formed in the inner surface of each of the chuck pieces 15*a*, 15*a*. On the inner surface of the chuck driver 13 are formed protuberances 13*a*, 13*a* protruding in the direction of diameter, and the chuck pieces 15*a*, 15*a*, of nearly a fan shape fitted in the chuck driver, are brought into contact therewith so as to be coupled and secured.

Bushings 16, 17 are provided at both front and rear ends of the cylinder 4 for reverse blowing connected to the front side of the intermediate cylinder 10, and a front head 19 having bushings 18, 19 provided in the inner surface side thereof is attached to the front side of the cylinder.

A rod-like shank rod 20 is inserted in the main body 2 of the drifter 1. The shank rod 20 is provided with a junction portion 22 of a large diameter having an internally threaded portion 22*a*, and is further provided with a blowing portion 23 of a large diameter at the intermediate portion thereof and with a slide portion 24 at the rear end thereof. A gap portion 20*a* between the junction portion 22 and the blowing portion 23, and a gap portion 20*b* between the side portion 24 and the blowing portion, are in the form of a round rod of a small diameter.

The blowing portion 23 of the shank rod 20 is formed nearly in the shape of a drum, both the front surface 23*b* and the rear surface 23*a* thereof serving as blowing surfaces. A male spline 25 is formed on the outer periphery of the blowing portion 23 and is fitted to the female spline 15*c* of the chuck.

A cylindrical piston 30 for forward blowing is fitted onto the round rod portion 20*b* on the rear side of the shank rod 20, and a cylindrical piston 33 for reverse-blowing is fitted onto the round rod portion 20*a* of the front side. A small gap t is maintained between these pistons and the round rod portion, so that the pistons are allowed to freely move back and forth.

The piston 30 for forward blowing and the piston 33 for reverse blowing have an equal size but are directed opposite to each other. Further, the cylinders 3 and 4 containing these front and rear pistons have the same shape and the same size, but are directed opposite to each other. Valve units 40, 43 for actuating the pistons are mounted on the outer peripheries of the cylinder 3 for forward blowing and of the cylinder 4 for reverse blowing.

A pilot valve unit 45 for blowing is mounted on the upper surface on the outer periphery of the intermediate cylinder 10 of the drifter 1, and a rotary pilot valve unit 47 for changing the rotation over to the forward direction or the reverse direction is mounted on the side surface thereof. In FIG. 1 illustrating the operation system, the rotary pilot valve unit 47 is shown in an expansion plan for the purpose of convenience and, hence, the two pilot valve devices 45 and 47 are shown being overlapped one upon the other. A rotary unit 50 is provided on the side surface of the intermediate cylinder 10 on the side opposite to the pilot valve unit 47. The rotary unit 50 includes a hydraulic motor 51 and a counter gear 52, the counter gear being in mesh with the tooth train 13*a* of the chuck driver 13, so that the rotation of the hydraulic motor 51 is transmitted to the chuck driver 13 through the counter gear 52.

Next, actions of the pilot valve units 45, 47 will be described based on the diagram of operation system. In the case of forward blowing, first, a high-pressure fluid enters into the pilot valve unit 45 for blowing through a port Pa when the drifter 1 moves forward and enters into the valve unit 40 for forward blowing passing through a port Pf to actuate the piston 32 for forward blowing. The return fluid at this moment is returned back to the fluid tank through port Pg, port Ph and port Pc.

In the case of the reverse blowing, the high-pressure fluid enters into the pilot valve unit 45 for blowing through the port Pa when the drifter 1 moves back. In this case, the pressurized fluid acts upon the pilot port Pd from a feed-backward circuit for moving the drifter 1 backward. When the pressurized fluid overcomes the pushing force of the spring 59, the valve 60 is changed over, and the pressurized fluid from the port Pa enters into the valve unit 43 for reverse blowing passing through the port Pi to actuate the piston 33 for reverse blowing. At this moment, the return fluid is sent back to the fluid tank through port Pj, port Ph and port Pc.

In the case of the forward rotation, the high-pressure fluid enters into the pilot valve unit 47 for rotation through the port Pb during the piercing, and reaches a forward rotation port P1 of the hydraulic motor 51 through the port Pk to rotate the shank rod 20 forward. In this case, the return fluid enters into the port Pn from the reverse rotation port Pm of the hydraulic motor 51, meets the return fluid from the blow return port Ph, and is returned back to the fluid tank through port Pc.

The reverse rotation is used for removing the rod fitted into the threaded portion of the junction portion of the shank rod 20. In this case, the high-pressure fluid enters into the pilot valve unit 47 for rotation at the feed-backward end through the port Pb and, at the same time, the fluid pressurized high enough to overcome the pushing force of the spring 61 acts on the pilot port Pe through the pilot port Pd, whereby the valve 65 is changed over, so that the pressurized fluid arrives at a reverse rotation port Pm of the hydraulic motor 51 through port Pb and port Pn thereby to rotate the shank rod 20 in reverse. The return fluid at this moment enters into the port Pk from the forward rotation port P1 of the hydraulic motor 51, enters the blow return port Ph, and is returned back to the fluid tank through port Pc.

Figure 6:
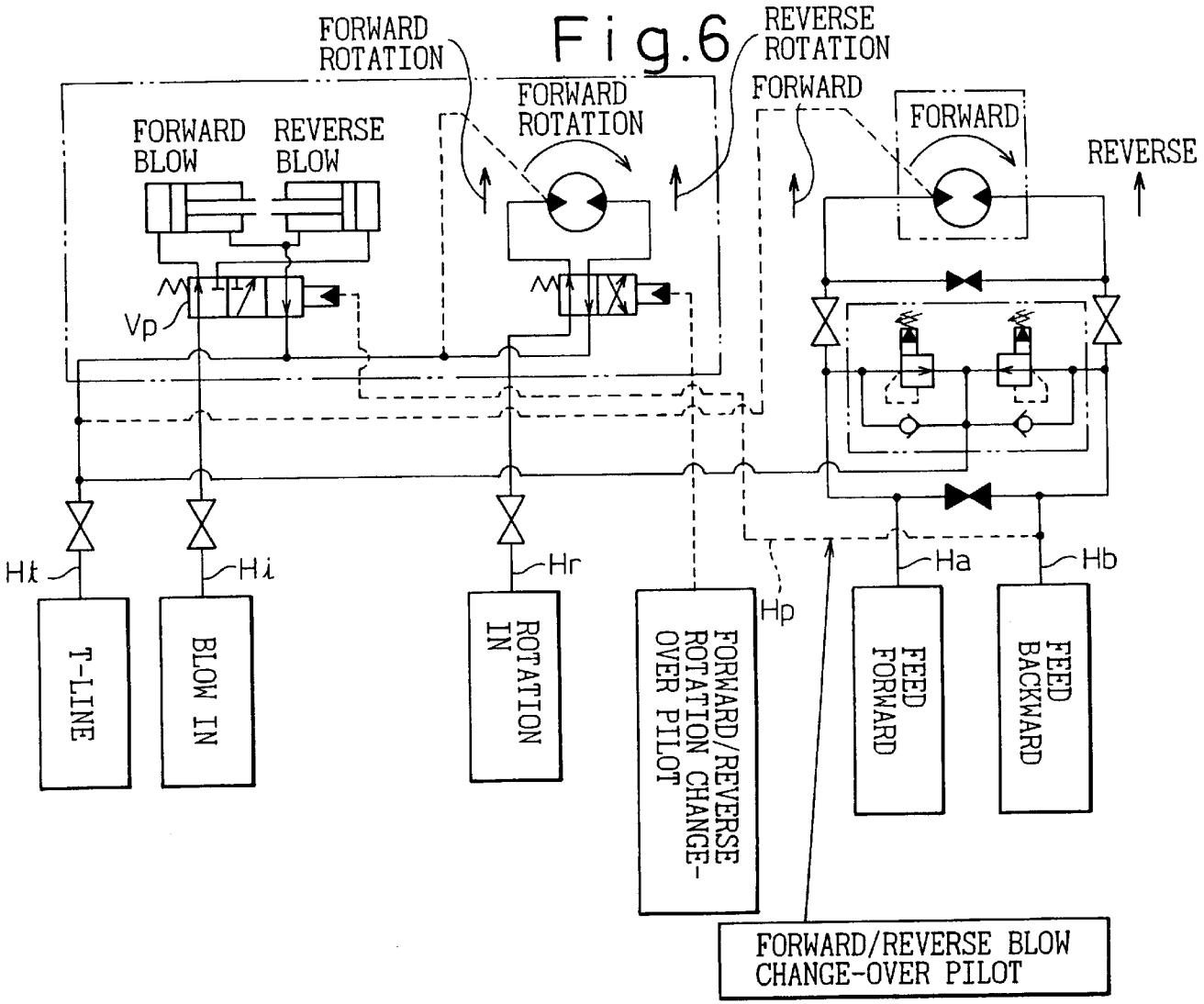
FIG. 6 is a diagram schematically illustrating hydraulic conduits.
Figure 7:
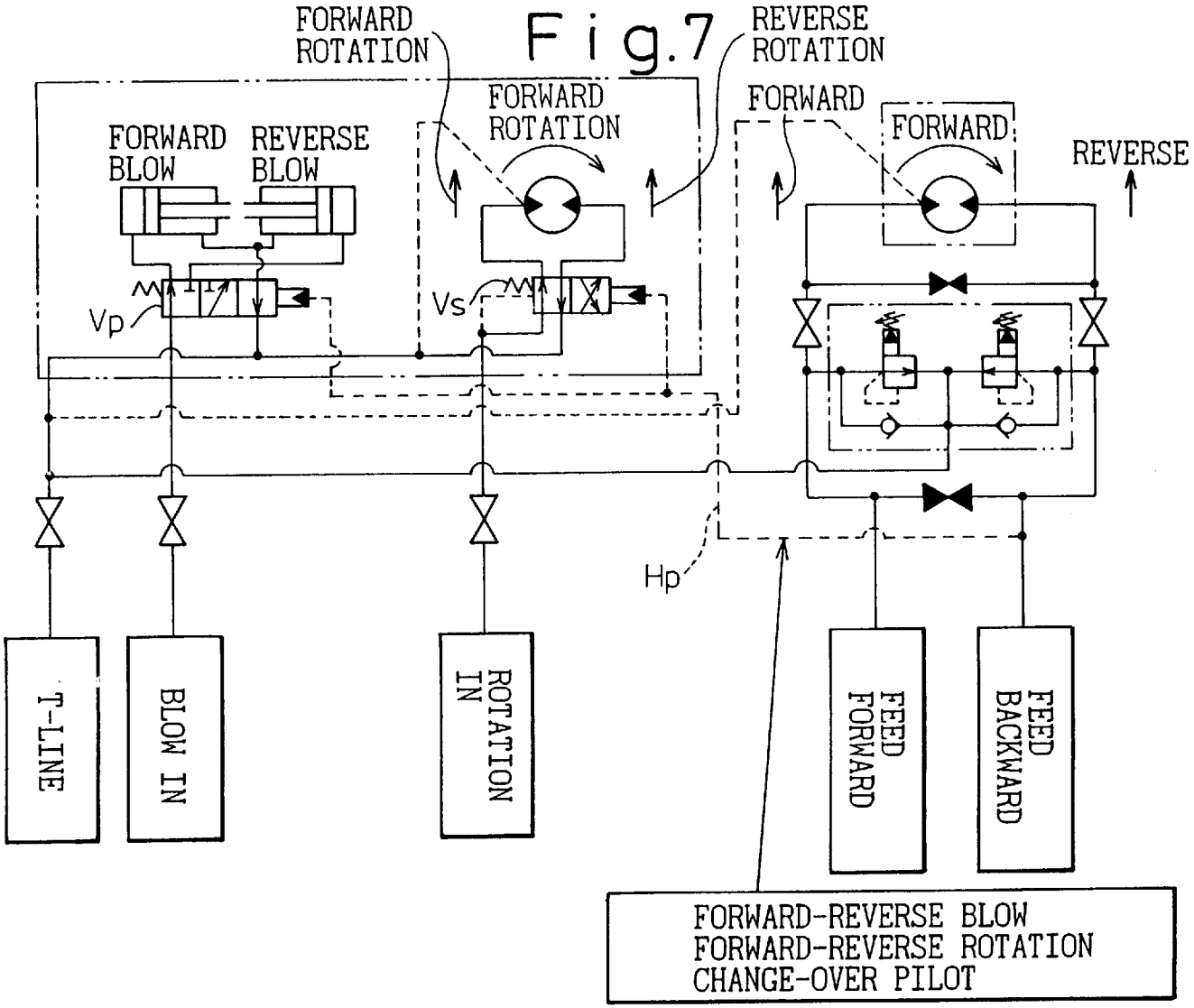
FIG. 7 is a diagram schematically illustrating hydraulic conduits different from those of FIG. 6.
Figure 8:
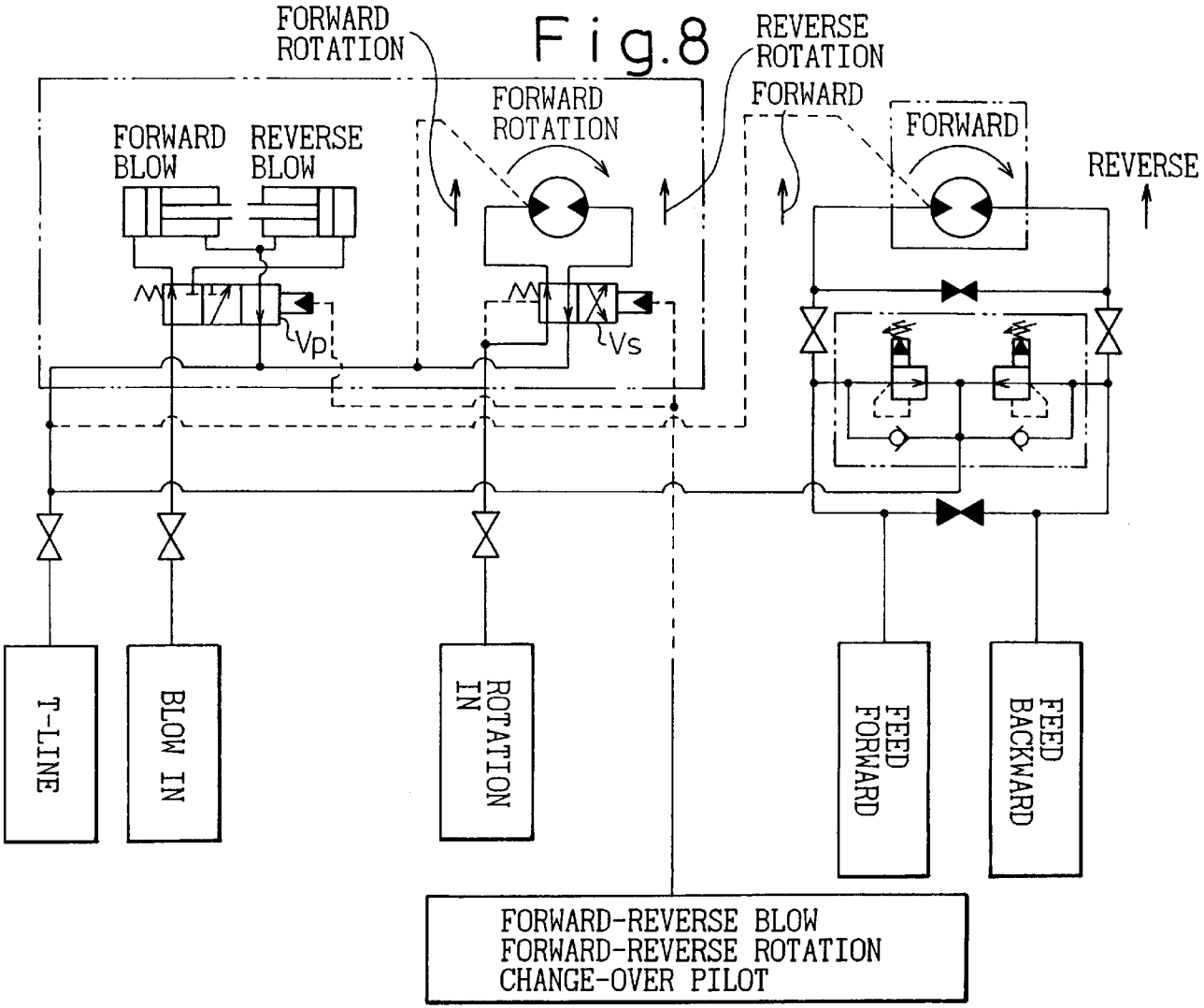
FIG. 8 is a diagram schematically illustrating hydraulic conduits further different from those of FIG. 6.

FIGS. 6 to 8 are diagrams of hydraulic conduits for operating the piercing apparatus 1, wherein local constitutions are slightly different depending upon the drawings. The drawings of these conduits do not include the conduits for swinging, moving up and down or centering up and down, the guide cell on which the drifter is mounted. As shown, the piercing apparatus 1 is provided with three thick hydraulic hoses, i.e., a hydraulic pressure feed hose (blow IN) Hi for blowing and rotating the drifter, a hydraulic pressure feed hose for rotation (rotation IN) Hr, and a return line (T-line) Ht returning from the blowing unit and the rotary unit. Further, to the feed unit for moving the drifter forward and backward, are connected two hydraulic hoses, i.e., a hydraulic hose Ha for feed forward and a hydraulic hose Hb for feed backward.

In the example of conduits of FIG. 6, a narrow pilot hose Hp for changing over the forward/reverse blow is connected to the conduit for feed backward, whereby a pilot pressure acts from the line of feed backward on the pilot valve Vp for changing over the forward/reverse blow so that, at the time of moving back, the blow is automatically changed over to the reverse blow. The rotation is usually in the forward direction. When the reverse rotation is required, a forward/reverse change-over solenoid valve Vs of the valve unit provided in the valve stand is turned on, thereby to obtain the rotation in the reverse direction.

FIG. 7 illustrates an example of conduits different from the above example. In this example of conduits, a narrow pilot hose Hp from the conduit for feed backward is connected to the valve Vs for changing over the rotation and to the pilot valve Vp for changing over the forward/reverse blow so that, when the load is exerted during the feed backward, the blow is automatically changed from the forward blow over to the reverse blow and the rotation is changed from the forward rotation over to the reverse rotation. In general, the reverse blow is required at the time of withdrawing the rod (metal rod) or when the load is exerted during the feed backward, In order to prevent the screws from being loosened at the coupling portions, the drifter is rotated forward. And a some degree of pressure is applied to the circuit for forward rotation and, besides, the valve spring sp produces a force. Therefore, the forward rotation is not changed over to the reverse rotation by the pilot pressure in the feed-backward circuit. The drifter must be rotated in reverse at the time when the operation is finished and the rod (metal rod) must be removed. In this case, the feed is brought to the backward limit, and the drifter is rotated in a state where the solenoid valve for backward motion is turned on (in a state where the pressure is exerted on the backward circuit); i.e., the drifter is rotated in the reverse direction. The method of FIG. 7 minimizes the number of conduits between the valve stand and the drifter.

FIG. 8 illustrates a further different example of the conduits. In this example of the conduits, the pilot valve for changing over the forward-reverse blow/forward-reverse rotation is actuated by an electromagnetic valve in the valve stand. According to this method, the individual modes are selected relying on the combinations of operations of the electromagnetic valves. Then, the forward/reverse blow and the forward/reverse rotation can be arbitrarily selected and executed.

Figure 9:
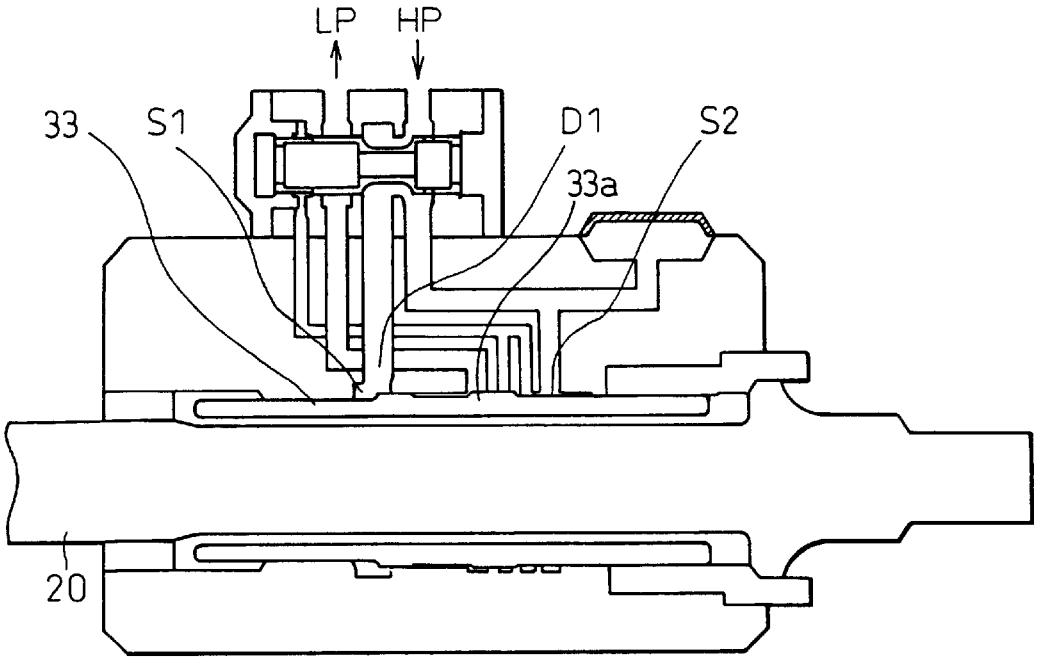
FIG. 9 is a view schematically illustrating the principle of operation of a piston.

Next, the blowing operation of the drifter 1 will be described with reference to the drawings. FIGS. 9 to 13 illustrate the reverse-blowing unit. In FIG. 9, the piston 33 is reaching the top dead center (front end position) and the high-pressure fluid acts on a rear piston chamber S1 from a high-pressure port D1. There is a relationship M1>M2 between the pressure-receiving area M1 of the rear piston chamber S1 and the pressure-receiving area M2 of a front piston chamber S2. As the high-pressure line is communicated with the rear piston chamber S1, therefore, a force acting on the rear part of the piston becomes larger than a force acting on the front part of the piston, and the piston enters into the blowing stroke and moves forward (moves toward the right in the drawing).

Figure 10:
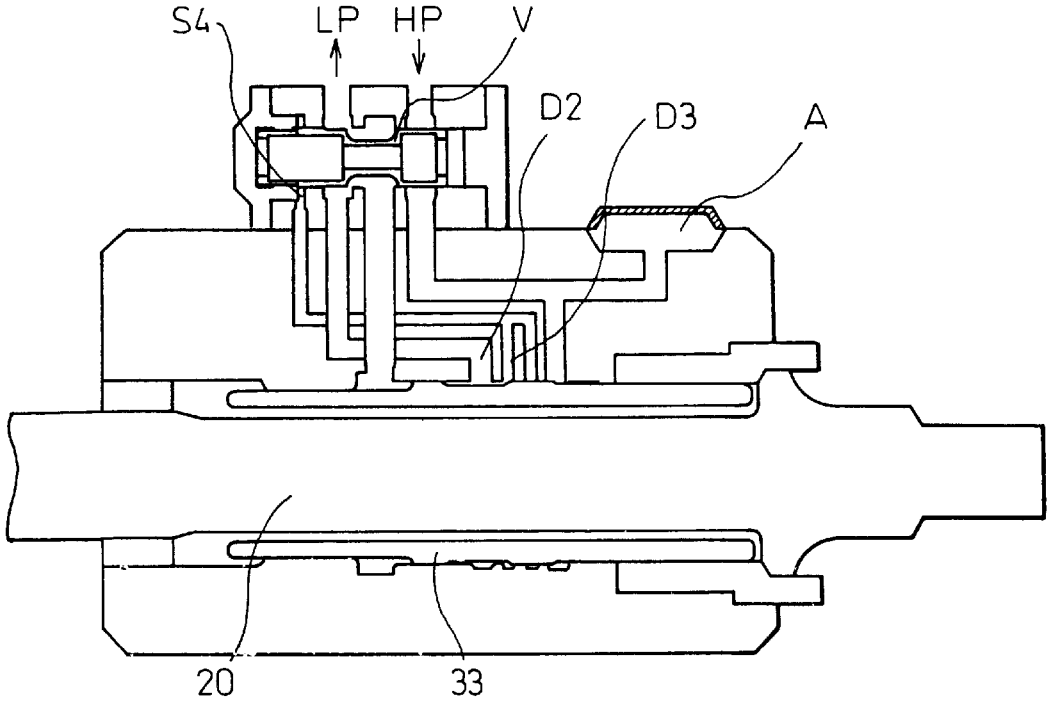
FIG. 10 is a view schematically illustrating the principle of operation of the piston.

In FIG. 10, the piston 33 continues to move forward and during this period, the accumulator A supplies the lacking amount of operation fluid. The piston further proceeds, and the large diameter portion 33*a* thereof opens the valve change-over port D3 so that it is communicated with a port D2 of the low-pressure line LP. Then, the pressure in the valve change-over chamber S4 decreases and the valve V starts changing over.

Figure 11:
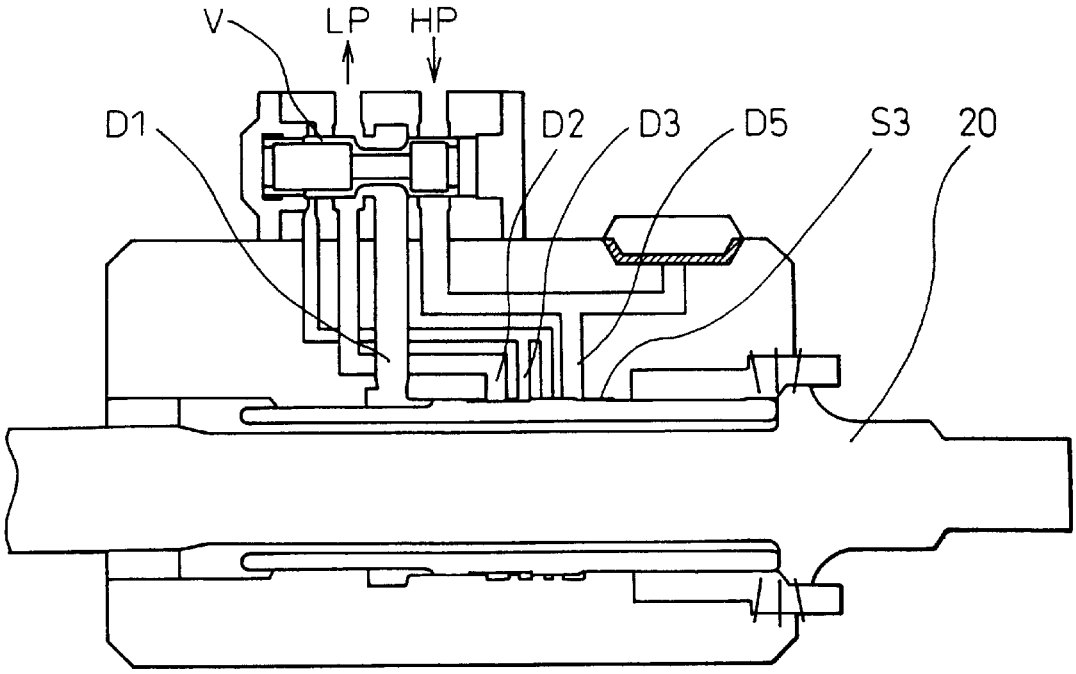
FIG. 11 is a view schematically illustrating the principle of operation of the piston.

In FIG. 11, the piston 33 reaches a point of reverse blow, transmits the kinetic energy which it has gained during the stroke of reverse blow to the shank rod 20 which then transmits the energy of reverse blow to the bit. At this moment, the valve V has been completely changed over, whereby the ports (D1, D2, D3) are all communicated with the low-pressure line LP, the force acting on the front part of the piston 33 becomes larger than the force acting on the rear part of the piston, and the piston enters into the stroke of moving backward. As the piston further moves forward beyond the point of reverse blow with no load, the piston closes the port D5, comes into a halt while forming a cushion chamber S3 and, then, starts moving backward.

Figure 12:
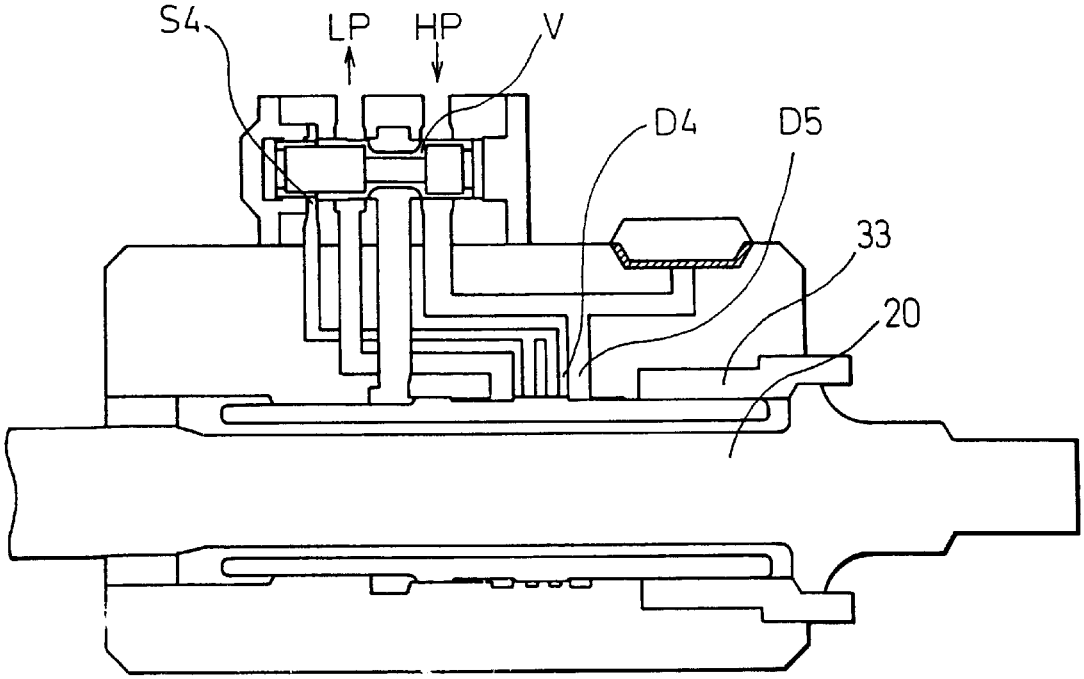
FIG. 12 is a view schematically illustrating the principle of operation of the piston.

In FIG. 12, the piston 33 continues to move backward, and the large diameter portion 33*a* opens the valve change-over port D4 so that it is communicated with the port D5 of the high-pressure line HP. Then, the pressure is elevated in the valve change-over chamber S4, and the valve V starts changing over.

Figure 13:
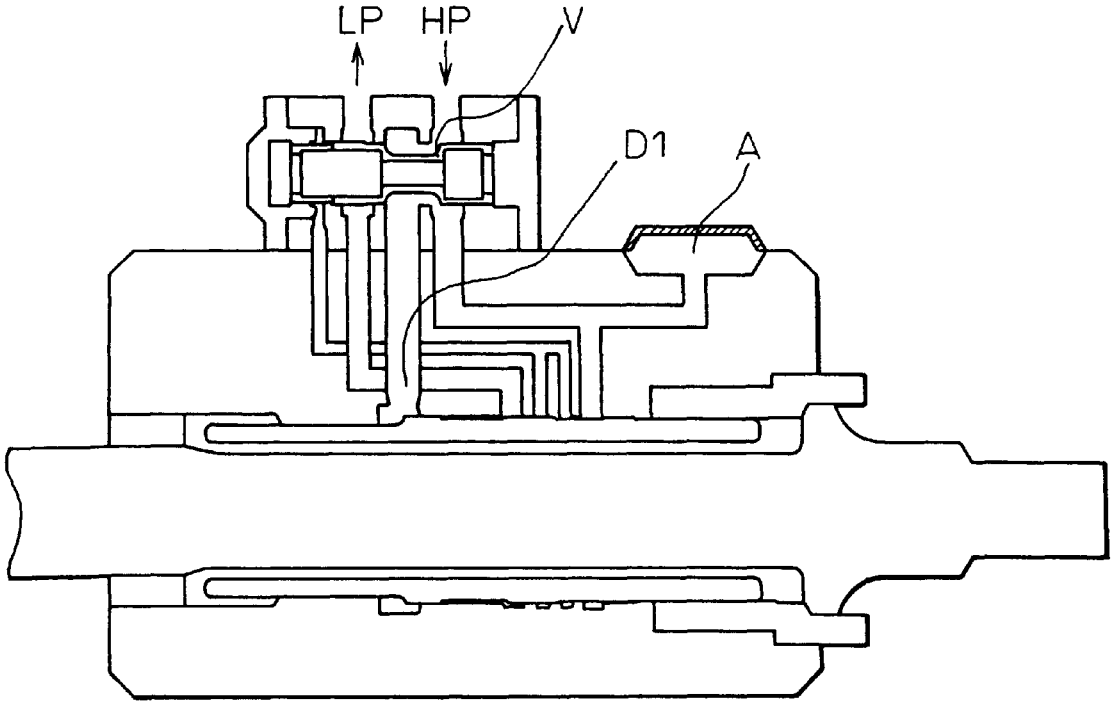
FIG. 13 is a view schematically illustrating the principle of operation of the piston.

In FIG. 13, the piston 33 for reverse blow continues to move backward and the valve V continues to be changed over. Then, the port D1 is communicated with the high-pressure line HP, and the high-pressure fluid enters into the rear piston chamber. Due to the inertial energy which the piston has gained during the stroke of backward movement, the rear piston chamber forms a cushion chamber in the high-pressure line, and the hydraulic pressure is accumulated in the accumulator A. As the valve V is completely changed over and the piston reaches the top dead center at where it is stopped by the cushion, the initial state of FIG. 7 is resumed.

The foregoing description has dealt with the operation of the reverse-blowing unit. The same, however, also holds for the case of the forward-blowing unit (the direction is reversed) which, therefore, is not described here.

Figure 14:
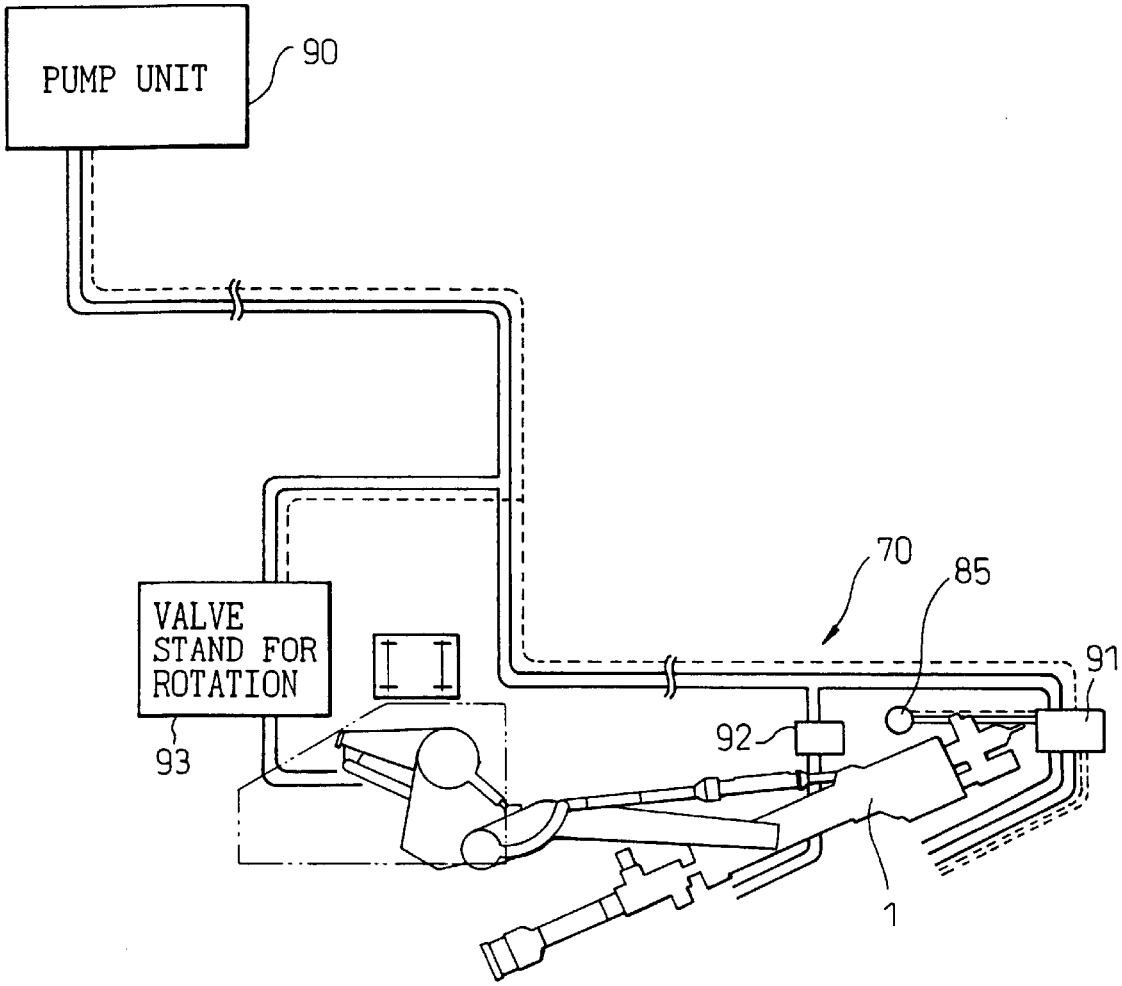
FIG. 14 is a plan view illustrating an example of using a piercing apparatus of the invention as an iron runner port-opening machine.
Figure 15:
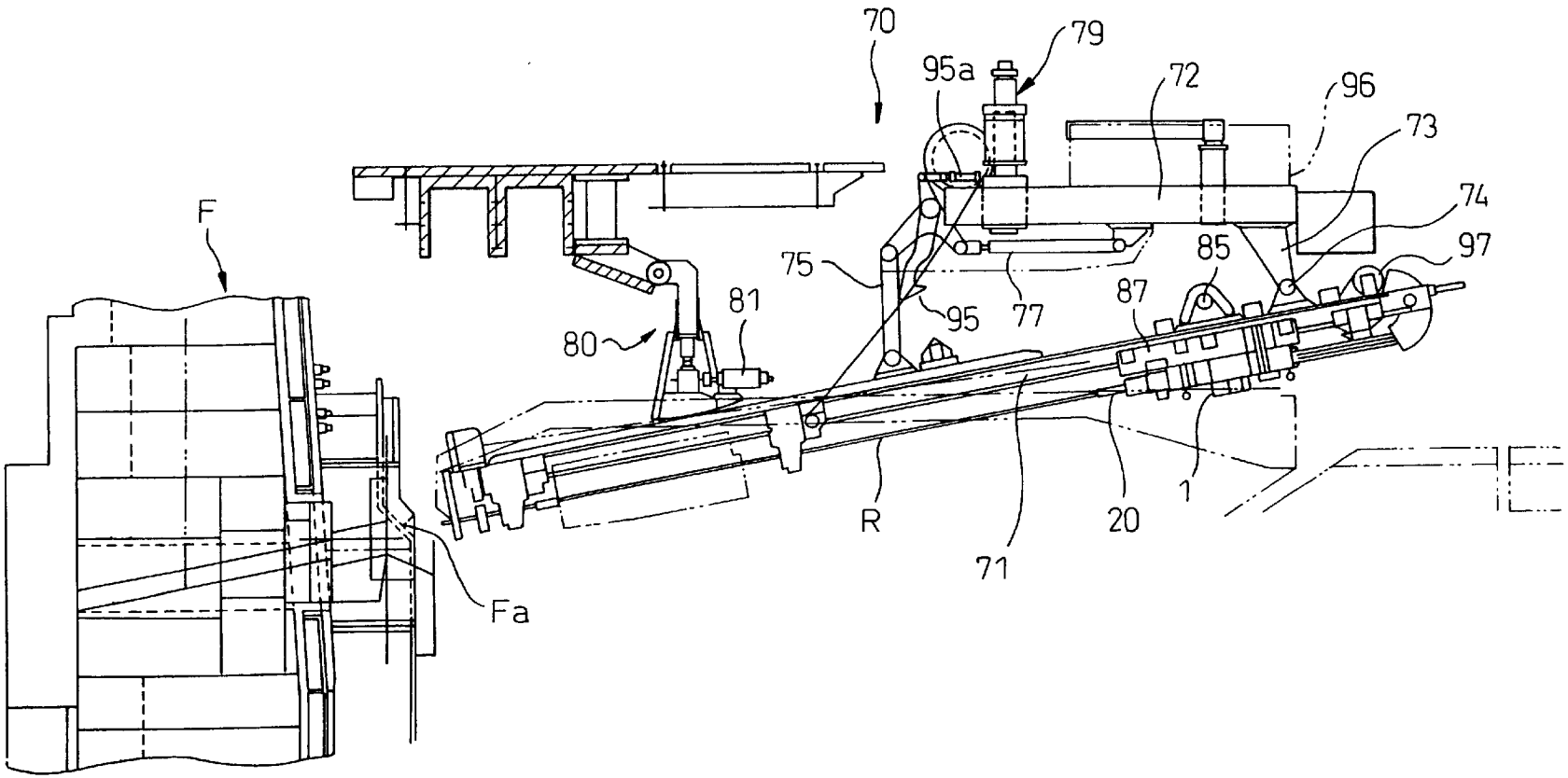
FIG. 15 is a side view of FIG. 14.

FIGS. 14 and 15 illustrate an example of using the piercing apparatus M as an iron runner port-opening machine for a blast furnace F, wherein the drifter 1 of the piercing apparatus M is attached to the guide cell 71 in a manner to move back and forth. The base portion of the guide cell 71 is supported by an arm 73 hanged from a swing base 72 via a shaft 74 so as to freely rotate up and down, and an intermediate portion thereof is supported by a lift unit 75. Reference numeral 77 denotes a hydraulic cylinder for lifting. Upon expanding and contracting the hydraulic cylinder 77, the guide cell turns up and down with the shaft 74 as a center. In the drawing, reference numeral 79 denotes a five-way swivel for the air and water, and 80 denotes an up-down centering unit for centering the guide cell in the up-and-down direction. The position of the end of the guide cell is adjusted in the up-and-down direction by forwardly or reversely rotating an air motor 81 for accomplishing the centering in the up-and-down direction.

In the drawing, reference numeral 85 denotes a hydraulic feed motor constituting a feed unit F attached to the guide cell 71. When the hydraulic feed motor 85 is rotated forward or reverse, a sprocket attached to the rotary shaft of the motor rotates, and a chain wrapped round the sprockets attached to the front end and the rear end of the guide cell moves back and forth. A carriage 87 is attached to the chain, and the drifter 1 is mounted on the carriage. Therefore, the drifter 1 moves back and forth accompanying the motion of the chain. Reference numeral 90 denotes a pump unit, 91 denotes a valve unit (containing a small manifold electromagnetic block) for the drifter, 92 denotes a valve unit containing an electromagnetic valve block for the lifting unit for raising and lowering the guide cell 71, reference numeral 93 denotes a valve stand mounting a valve unit for swinging, 95 denotes a safety hook rotated by an air cylinder 95*a*, reference numeral 96 denotes an air electromagnetic valve box, and 97 denotes an encoder for detecting the depth of the hole.

The valve unit 91 for the drifter is the one in which the valve for changing over whole or part of the hydraulic pressure supplied to the blowing unit, rotary unit and feed unit, and the valve for controlling the flow rate and pressure, are installed in a heat-resistant box mounted on the guide cell, and is provided with cooling means for forcibly cooling the interior of the heat-resistant box by purging the air or a like method. The valves that are contained in the box having resistance against the heat are protected from high temperatures when the apparatus is used for opening the iron running port of the blast furnace and, besides, the apparatus is realized in a compact size. It is further desired to contain, in the above heat-resistant box, the valve for changing over whole or part of the hydraulic pressure supplied to the pilot valve that changes over the directions of the blowing unit and of the rotary unit, as well as the valve for controlling the flow rate and pressure.

To use the piercing apparatus M as the iron running port-opening machine, a piercing rod R is connected to the shank rod 20 of the drifter 1, and a bit is attached to the end of the piercing rod. The direction and inclination of the drifter 1 are so adjusted that the bit comes in contact with a desired piercing portion, the feed unit is actuated to fit the bit to the piercing position (e.g., iron running port Fa of the blast furnace), and the forward-blowing unit and the rotary unit are actuated. Thus, the piercing operation is executed as desired.

After the piercing is effected to a predetermined depth, the drifter 1 is moved backward to withdraw the bit and the rod from the hole that is pierced. At this moment, the feed unit is changed over to the side of moving backward, whereby the pilot valve unit 45 operates, and the supply of hydraulic pressure for blowing is changed from the valve for forward blowing over to the valve for reverse blowing. Thus, the blowing is changed from the forward blow which gives blow to the rod in the forward direction over to the reverse blow which gives blow in the reverse direction. Even in case the bit cannot be withdrawn due to the pieces and scraps of the piercing operation in the hole on the back side of the bit, the blow in the reverse direction helps to easily withdraw the bit.

The hydraulic pressure can be supplied from the hydraulic pump to the drifter 1 by using the hydraulic hose for forward blowing and the hydraulic hose for reverse blowing, and the return fluid from the blowing unit and the return fluid from the rotary unit are returned back to the fluid tank through the common hydraulic hose, making it possible to decrease the number of thick hydraulic hoses extending along the outer side, and the apparatus is realized in a compact size featuring easy operation. In the diagramed drifter, further, the rod connection portion of the shank rod is internally threaded enabling the external thread of the piercing rod to be directly screwed therein and connected. Compared to the prior art using a coupling sleeve, therefore, the blowing force can be efficiently transmitted. However, this portion may be constructed similarly to that of the prior art.

According to the piercing apparatus of the present invention as described above, the shank rod having, in the intermediate portion thereof, a blowing portion with blowing surfaces on the front and rear sides thereof, is used as a shank rod of the drifter, cylindrical pistons are fitted to the front and rear sides of the blowing portion to apply forward/reverse blow by the pistons on the front and rear sides thereof. Therefore, the overall length is decreased to realize the apparatus in a compact size. Further, the pilot valve is provided for changing over the forward blow and the reverse blow. At the time when the device for feeding the drifter is changed over to the side of backward motion, the pilot valve is operated to change the forward blow over to the reverse blow. Accordingly, the hydraulic pressure feed (IN) hose can be used in common for the forward blow and for the reverse blow. Further, the return circuits of the blow and rotation are formed as a T-line, and the return fluids of the blow and rotation are returned back to the tank through the common return hose. Therefore, only three thick hoses are required, contributing to simplifying the external structure and improving the operability.

What is claimed is:

1. A piercing apparatus for executing piercing by moving back and forth, by using a feed unit, a drifter equipped with a forward-blowing unit, a reverse-blowing unit and a rotary unit, wherein:

cylinders containing a cylindrical blowing piston are provided in front of, and at the back of, a drifter body at a distance relative to each other;

a shank rod having, formed as a unitary structure, a blowing portion of a large diameter with blowing surfaces formed on the front and rear portions thereof and rod-like small-diameter portions protruding forward and backward beyond the blowing portion, is provided along the axial direction of the drifter body in a manner that the blowing portion is positioned between the front cylinder and rear cylinder and that the small-diameter portions on both sides are fitted to the cylindrical blowing pistons of the respective sides; and valves are provided in the outer peripheral portions of the front and rear cylinders to supply hydraulic pressure into the cylinders.

2. A piercing apparatus according to claim 1, wherein a chuck that transmits the rotation being spline-fitted to the blowing portion, is rotated by the rotary unit provided on the outer peripheral portion of the drifter body.

3. A piercing apparatus according to claim 1 or 2, wherein an end portion of the shank rod attached to the drifter is internally threaded, and the base portion of a piercing rod extending from the drifter is screwed into the internally threaded portion and is connected thereto.

* * * * *